US005310395A

United States Patent [19]

Ko

[11] Patent Number: 5,310,395

[45] Date of Patent: May 10, 1994

[54] EXERCISING APPARATUS

[75] Inventor: Ching-Ho Ko, Chang Hua Hsien, Taiwan

[73] Assignee: Yow Li Feng Industrial Co., Ltd., Chang-Hua Hsien, Taiwan

[21] Appl. No.: 142,000

[22] Filed: Oct. 28, 1993

[51] Int. Cl.[5] ..... A63B 23/10; A63B 21/04

[52] U.S. Cl. ..... 482/146; 482/79; 482/70

[58] Field of Search ..... 482/79, 80, 146, 147, 482/70, 34, 51, 121, 122, 123, 129

[56] References Cited

U.S. PATENT DOCUMENTS

| | | | |
|---|---|---|---|
| 735,319 | 8/1903 | Urwick | 482/146 |
| 2,351,293 | 6/1944 | Saunders | 482/147 |
| 4,629,181 | 12/1986 | Krive | 482/146 |
| 4,822,039 | 4/1989 | Gonzales et al. | 482/146 |
| 5,002,272 | 3/1991 | Hofmeister | 482/146 |

*Primary Examiner*—Stephen R. Crow

*Attorney, Agent, or Firm*—Morton J. Rosenberg; David I. Klein

[57] ABSTRACT

An exercising apparatus includes a base having two upright handles on two opposite sides thereof and a ball bearing, a rotary table supported on the ball bearing and moved to turn thereon and having an upright support in the center, a foot board balanced on the upright support and moved to turn the rotary table on the ball bearing of the base, and tensile elements bilaterally connected between the rotary table and the foot board for permitting the foot board to be alternatively oscillated back and forth.

5 Claims, 3 Drawing Sheets

EXERCISING APPARATUS

BACKGROUND OF THE INVENTION

The present invention relates to an exercising apparatus which can be used for exercising twist and practicing the game of surfriding.

Various exercising apparatus have been disclosed, and have appeared on the market. These apparatus are commonly designed for a specific purpose. Therefore, different exercising apparatus must be used for different exercises. Although there are universal gyms commercially available for multiple purposes, these universal gyms are commonly heavy and expensive.

SUMMARY OF THE INVENTION

It is one object of the present invention to provide an exercising apparatus which can be used for stepping the legs, twisting the body, and practicing the game of surfriding. It is another object of the present invention to provide an exercising apparatus which is simple and lightweight, and which can be quickly set up. According to the preferred embodiment, the exercising apparatus is comprised of a base having two upright handles on two opposite sides thereof and a seat formed of a ball bearing, a rotary table mounted on the seat of the base and moved to turn thereon, a foot board balanced on an upright support on the rotary table and moved to turn the rotary table on the seat of the base, and tensile elements bilaterally connected between the rotary table and the foot board for permitting the foot board to be alternatively oscillated back and forth.

DETAILED DESCRIPTION OF THE PREFERRED EMBODIMENT

Figure 1:
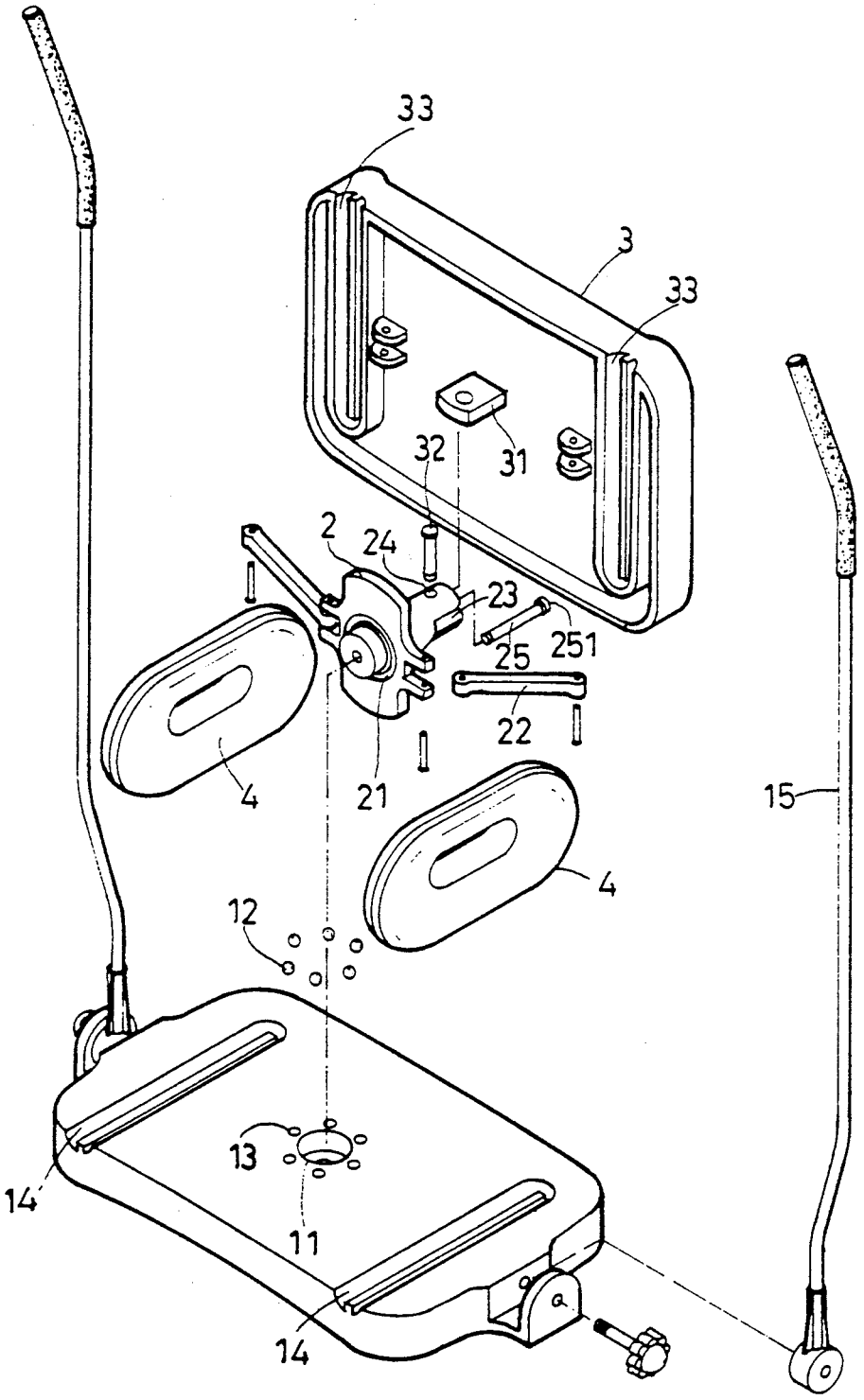
FIG. 1 is an exploded view of an exercising apparatus according to the preferred embodiment of the present invention.
Figure 2:
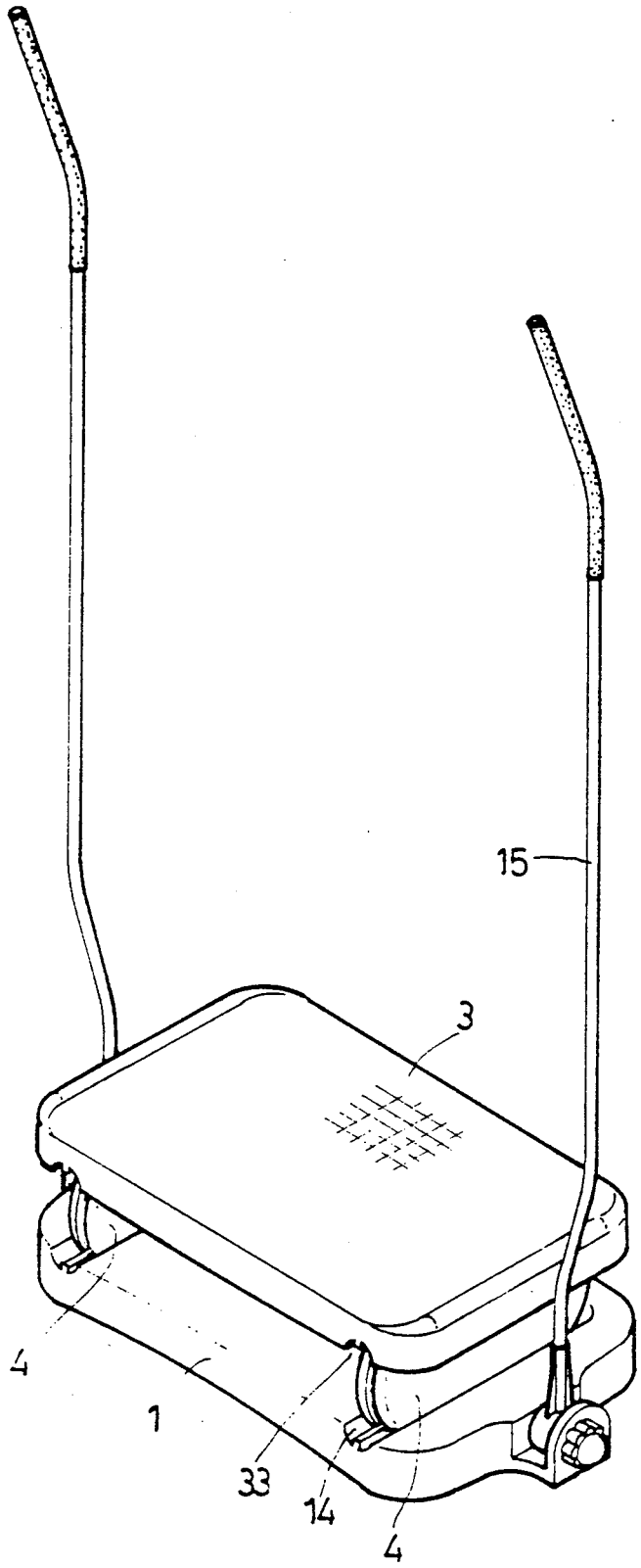
FIG. 2 is an elevational view of the exercising apparatus of FIG. 1.
Figure 3:
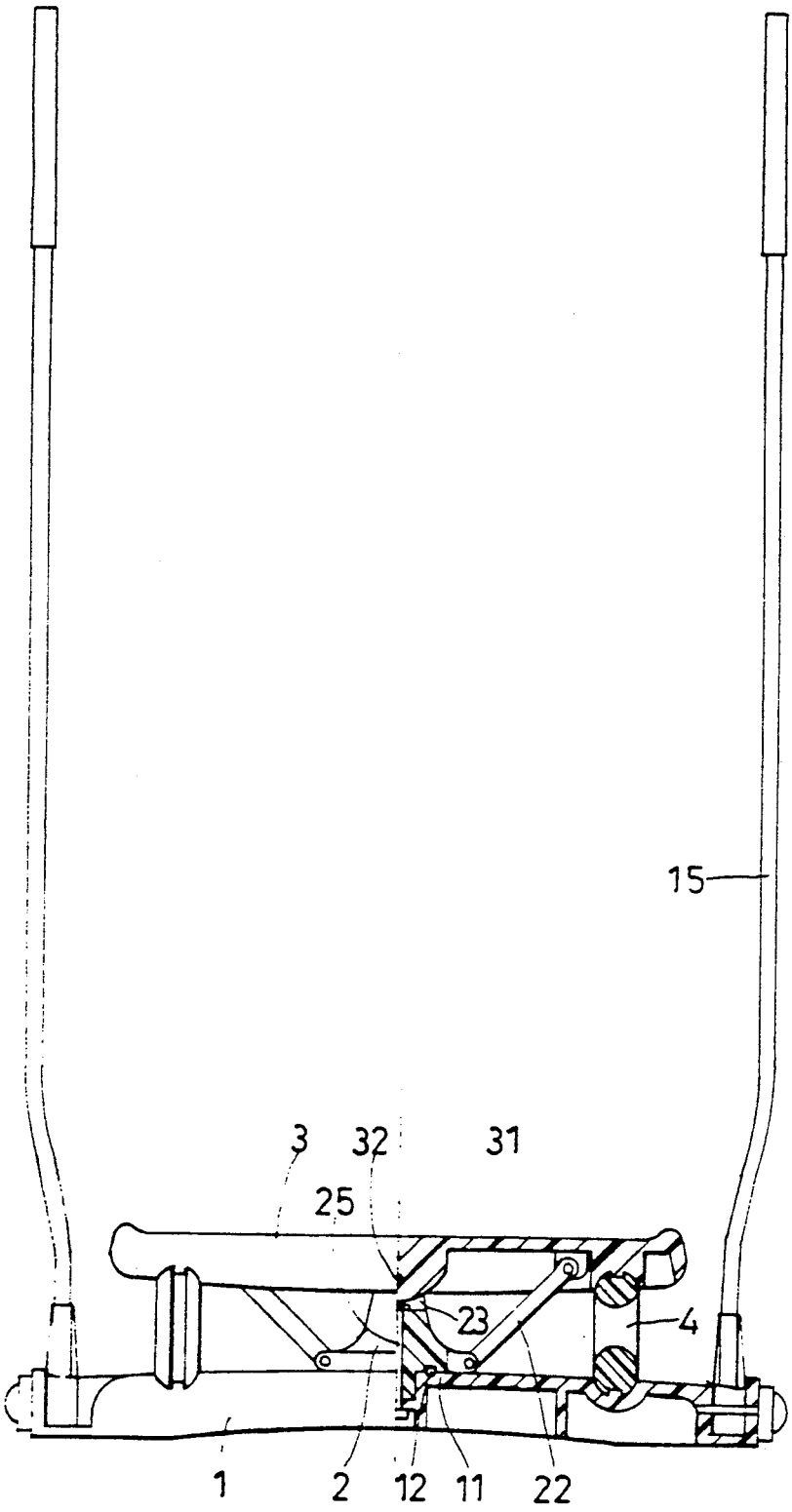
FIG. 3 is a side view with partial section of the exercising apparatus of FIG. 1.

Referring to FIGS. 1, 2, and 3 in detail, an exercising apparatus in accordance with the present invention is generally comprised of a base 1, a rotary table 2, and a foot board 3. The base 1 is made to place on the ground in a horizontal position, having a rotary table mounting seat 11 in the center. A plurality of recessed holes 13 are made on the top surface of the base 1 around the rotary table mounting seat 11, each receiving a respective steel ball 12. The base 1 further comprises two parallel grooves 14 transversely disposed on the top, and two upright handles 15 disposed on two opposite sides for the holding of the hands. The rotary table 2 is revolvably mounted on the rotary table mounting seat 11, comprising an annular bottom groove 21, which receive the steel balls 12 in the recessed holes 13, two rubber tensile elements 22 bilaterally connected to the foot board 3, an upright support 23 in the center with a pivot hole 24, and a headed connecting rod 25 inserted through a center hole (not shown) thereof. The headed connecting rod 25 has a top end terminated to an expanded head 251 stopped above the center hole of the rotary table 2, and a bottom end inserted through a hole (not shown) on the rotary table mounting seat 11 and retained to the base 1. By means of the steel balls 12, the rotary table 2 can be turned on the base 1. The foot board 3 comprises a bottom lug 31 pivoted to the upright support 23 of the rotary table 2 by a pivot 32, which is inserted into the pivot hole 24 on the upright support 23, and two parallel grooves 33 bilaterally disposed on the bottom thereof corresponding to the parallel grooves 14 on the base 1. When assembled, the player can stand on the foot board 3 with the hands held on the upright handles 15 to alternatively step the feet on the foot board 3 so as to alternatively oscillate the foot board 3 back and forth in the longitudinal direction (along the line through the upright handles 15) like playing the game of surfriding. Alternatively, the player may twist the body to turn the foot board 3 and the rotary table 2 on the base 1. As the foot board 3 is balanced on the upright support 23 of the rotary table 2, the player may stand on the foot board 3 in either direction.

Referring to the annexed drawings again, there are also provided two counter weights 4 which can be respectively inserted between the parallel grooves 14 on the base 1 and the parallel grooves 33 on the foot board 3 to hold the foot board 3 in position, and therefore the foot board 3 is maintained stable. These counter weights 4 may be removed from the base 1 for use in exercising the arms.

What is claimed is:

1. An exercising apparatus comprising:

a base having a seat in the center;

a rotary table mounted on said seat of said base and moved to turn on said seat of said base, said rotary table having an upright support;

a foot board having a bottom lug pivoted to said upright support of said rotary table at the top; and two tensile elements bilaterally connected between said rotary table and said foot board for permitting said foot board to be alternatively oscillate back and forth on said rotary table.

2. The exercising apparatus of claim 1 wherein said rotary table is fastened to said seat of said base by a locating rod, said locating rod being inserted through a center hole on said rotary table and having a top end terminated to a h®ad stopped above said center hole and a bottom end inserted through a hole on said seat of said base and retained to said base.

3. The exercising apparatus of claim 1 wherein said base and said foot board have a respective pair of parallel grooves for mounting two counter weights between said base and said foot board to hold said foot board in position.

4. The exercising apparatus of claim 1 wherein said rotary table has an annular groove on a bottom thereof; said seat of said base comprises a plurality of recessed holes arranged around a circle, and a plurality of steel balls partially received in said recessed holes and partially received in said annular groove of said rotary table to support said rotary table on said base for permitting said rotary table to be turned on said base.

5. The exercising apparatus of claim 1 wherein said base comprises two upright handles disposed on two opposite sides.

* * * * *